US006964299B2

(12) United States Patent
Scarsdale

(10) Patent No.: US 6,964,299 B2
(45) Date of Patent: Nov. 15, 2005

(54) SUBMERSIBLE PUMPING SYSTEM

(75) Inventor: Kevin T. Scarsdale, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 118 days.

(21) Appl. No.: 10/639,838

(22) Filed: Aug. 13, 2003

(65) Prior Publication Data

US 2005/0034871 A1 Feb. 17, 2005

(51) Int. Cl.[7] ..... E21B 43/12; F04D 29/44
(52) U.S. Cl. ..... 166/105; 166/369; 417/244; 417/423.5
(58) Field of Search ..... 166/269, 311, 369, 166/68, 105; 417/244, 423.5, 426, 63

(56) References Cited

U.S. PATENT DOCUMENTS 4,981,175 A * 1/1991 Powers ..... 166/265
6,196,312 B1 * 3/2001 Collins et al. ..... 166/265
6,547,003 B1 * 4/2003 Bangash et al. ..... 166/106
6,602,059 B1 * 8/2003 Howell et al. ..... 417/423.3
6,811,382 B2 * 11/2004 Buchanan et al. ..... 417/244
2003/0116323 A1 6/2003 Pettigrew

OTHER PUBLICATIONS

Pettigrew, Dana & Bob Kipp; Tandem Upper Tandem ESP Motor System Increases Pump Capacity By 67% in Field Tests; Feb. 6, 2002; pp. 10.

* cited by examiner

*Primary Examiner*—Frank S. Tsay

(74) *Attorney, Agent, or Firm*—Robert Van Someren; Bryan P. Galloway; Jaime A. Castaño

(57) ABSTRACT

A submersible pumping system is provided for the movement of fluids. The system utilizes a first electric submersible pumping system that cooperates with a second electric submersible pumping system. The arrangement enables increased horsepower in a space efficient package.

29 Claims, 3 Drawing Sheets

SUBMERSIBLE PUMPING SYSTEM

BACKGROUND

In a variety of subterranean environments, submersible pumping systems are used in the production of hydrocarbon based fluids or other types of fluids. A relatively narrow wellbore is drilled, and the pumping system is deployed into the wellbore via, for example, a suspension cable or deployment tubing. Depending on well parameters, the production of fluid, e.g. oil, can be limited by the available horsepower from a given submersible motor or motors used to drive a submersible centrifugal pump. Available horsepower is limited because horsepower generated by the system is transferred through a single shaft to the pump. Due to diameter restrictions, use of a larger shaft to accommodate greater horsepower would require space needed by the centrifugal pump to maintain pumping efficiency.

Sometimes, tandem installations are deployed downhole to increase the production rate. For example, a Y-tool can be used to suspend two electric submersible pumping systems that are offset from each other. However, the offset equipment limits the size of the systems that can be placed into a particular wellbore.

SUMMARY

In general, the present invention provides a submersible pumping system for use in movement of a fluid from one location to another. For example, the fluid may be moved from a wellbore to a collection point. The submersible system utilizes at least a pair of electric submersible pumping systems in a space efficient package that enables substantially increased, e.g. doubled, power output within a wellbore of a given size.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to fluid production equipment and related methods. The equipment and methods are useful in, for example, the production of hydrocarbon based fluids, such as oil, from subterranean locations. However, the equipment and methods of the present invention are not limited to those fluids and locations. For example, the system can be used in non-oilfield applications, such as mine dewatering, supplying potable water, water injection, waste fluid disposal and other applications.

The embodiments described are amenable, for example, to use in a high horsepower system. As the power is increased in an electric submersible pumping system, the horsepower capacity of the shaft that runs through the system becomes inadequate. In the following embodiments, multiple systems are used in tandem while remaining mechanically independent, i.e. the drive shafts of the multiple systems are not coupled to each other. Thus, the benefit of greater system horsepower is achieved without the problems associated with a single drive shaft.

Figure 1:
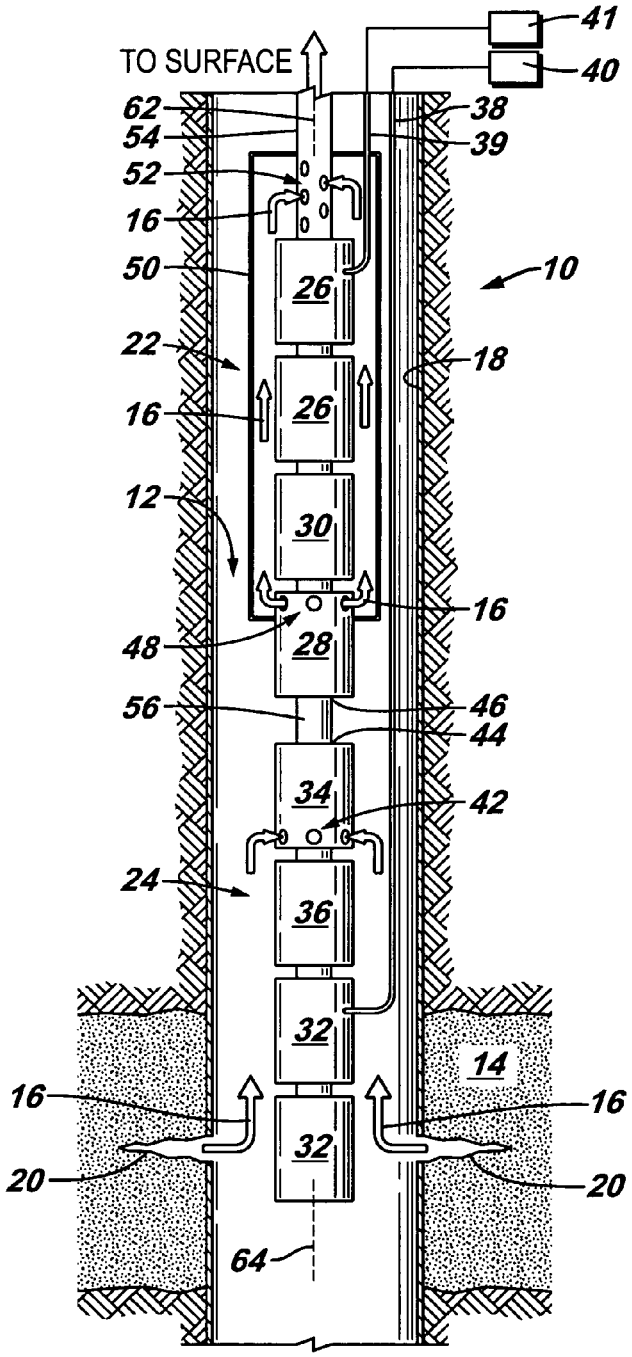
FIG. 1 is a front elevational view of a submersible pumping system, according to an embodiment of the present invention.

Referring generally to FIG. 1, a submersible pumping system 10 is illustrated, according to an embodiment of the present invention. The overall system 10 may be deployed in a wellbore 12 extending to a given subterranean formation 14. Subterranean formation 14 typically contains a desired fluid 16, such as oil, that flows into wellbore 12 for production to a desired location, e.g. the surface of the Earth, via pumping system 10. In many applications, wellbore 12 is lined with a liner or casing 18 and perforations 20 are formed through the casing to enable the flow of fluid from subterranean formation 14 into wellbore 12.

In the embodiment illustrated, pumping system 10 comprises a plurality of electric submersible pumping systems, such as a first electric submersible pumping system 22 and a second electric submersible pumping system 24. In this embodiment, the first electric submersible pumping system 22 is a downstream system, e.g. an upper system, and the second electric submersible pumping system 24 is an upstream system, e.g. a lower system in the application illustrated. It should be noted that additional electric submersible pumping systems can be added, but a pair of systems 22, 24 is illustrated to facilitate explanation of system operation.

Although each electric submersible pumping system may comprise a variety of components depending on the specific application, the embodiments illustrated show basic components that are utilized in typical electric submersible pumping systems. In the embodiment of FIG. 1, first electric submersible pumping system 22 is an inverted system, sometimes referred to as a bottom intake electric submersible pumping system. In this type of system, a submersible motor or motors 26 drive a submersible pump 28 located upstream, e.g. below, motors 26. A motor protector 30 may be positioned between motors 26 and pump 28. By way of example, one, two or three motors 26 can be used to run one, two or three connected pumps 28.

On the other hand, electric submersible pumping system 24 is a conventional system, i.e. not an inverted system. The example illustrated comprises a submersible motor 32 that powers a submersible pump 34 disposed downstream, e.g. above, motor 32. As with pumping system 22, power may be provided by a plurality of motors 32, such as the tandem motors 32 illustrated. Also, one, two or three connected motors 32 can be used to run one, two or three connected pumps 34. A motor protector 36 is deployed between motors 32 and pump 34. In some applications, the systems can be run with a gas handler (compressor) or a gas separator if there is sufficient gas in the downhole formation.

Upper system 22 and lower system 24 are powered independently by power cables 38 and 39 connected to drives 40 and 41, respectively, e.g. surface drives. In the embodiment illustrated, the two systems are electrically independent. The total power available to pumping system 10 is shared between the two electric submersible pumping systems. However, both electric submersible pumping systems may be powered simultaneously by a single cable 38 extending from a single drive, such as drive 40. Alternatively, a single drive, such as drive 40, can run power through a split cable extending into the well to a motor of each system. In this latter configuration, a switch (not shown) can be placed in each line after the split from drive 40. Each switch may contain a motor controller that allows the electric submersible pumping systems to be started and shutdown individually. Thus, the switches are able to provide independent motor protection to each electric submersible pumping system even though the systems are powered by the same drive.

As explained more fully below, upper system 22 and lower system 24 also are mechanically independent. In other words, although the two systems may be physically connected, the operation of one electric submersible pumping system is not tied to operation of the other by, for example, a common shaft. The two systems are, however, hydraulically connected in the sense that submersible pump 34 of system 24 delivers fluid to submersible pump 28 of system 22.

In one mode of operation, second electric submersible pumping system 24 is initially started, and first electric submersible pumping system 22 is started thereafter. Pumping system 24 draws fluid 16 along wellbore 12 to a pump intake 42 of submersible pump 34. By way of example, submersible pump 34 may comprise a centrifugal style pump. Regardless of pump type, fluid 16 is moved through submersible pump 34 and discharged through a pump discharge 44. The discharged fluid is directed to a pump intake 46 of submersible pump 28, e.g. a centrifugal pump. Because the illustrated pumping system 22 is a bottom intake electric submersible pumping system, fluid 16 is discharged from pump 28 through a fluid discharge end 48 for routing around, e.g. along, motor protector 30 and motors 26. (It should be noted that when the motors are sequentially started, the non-operating system may turn as fluid is forced through the system by the operating pump. Therefore, it may be beneficial if the motor controller associated with the drive of the non-operating system has the capability of "catching a spinning motor" to facilitate starting of the motor. This functionality is present in a variety of available motor controllers.)

In the embodiment illustrated, fluid 16 moves from fluid discharge 48 into a shroud 50 which, in turn, guides the fluid along the exterior of pumping system 22 to a fluid inlet 52 disposed in a tubing 54. Tubing 54 may comprise production tubing, coiled tubing or other types of tubing for conducting fluid 16 to a desired location, such as a collection point. Tubing 54 also can be used to suspend electric submersible pumping systems 22,24 within, for example, a wellbore. Fluid inlet 52 is disposed at a downstream location with respect to first electric submersible pumping system 22. Shroud 50 may be sealed around tubing 54 to ensure fluid 16 is forced into fluid inlet 52 and through the interior of tubing 54.

Operationally, the electric submersible pumping systems are mechanically independent. However, the first electric submersible pumping system 22 may be physically connected to second electric submersible pumping system 24 in the sense they are affixed to each other. For example, a coupling 56 may be used to connect the two systems and to conduct the flow of fluid 16 from submersible pump 34 directly to submersible pump 28.

Figure 2:
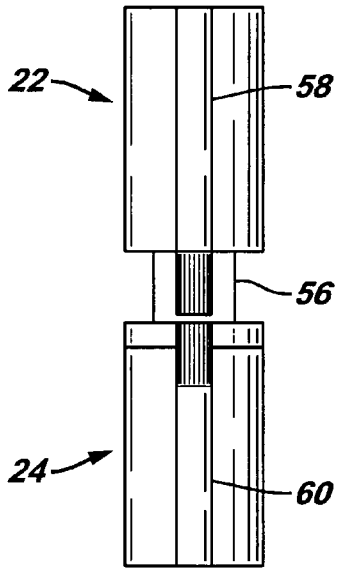
FIG. 2 is a schematic illustration of one embodiment for coupling the upper electric submersible pumping system to the lower electric submersible pumping system illustrated in FIG. 1.

As illustrated best in FIG. 2, first electric submersible pumping system 22 comprises a first drive shaft 58 by which the motor or motors 26 drive submersible pump 28. Similarly, second electric submersible pumping system 24 comprises a second drive shaft 60 by which motor or motors 32 drive submersible pump 34. However, first drive shaft 58 is not linked to second drive shaft 60, thereby enabling independent operation of each electric submersible pumping system.

Referring to both FIG. 1 and FIG. 2, first electric submersible pumping system 22 has an axis or centerline 62. Similarly, second electric submersible pumping system 24 has an axis or centerline 64. Efficient use of space may be achieved by aligning centerline 62 and centerline 64 to create a common centerline for both electric submersible pumping systems. With little or no offset, the power of each electric submersible pumping system is more readily maximized. The result is a system that can deliver twice the lift when compared to an individual system. However, because the systems are mechanically independent, the drive shaft 58, 60 of each system must only carry the horsepower associated with that individual system.

Figure 3:
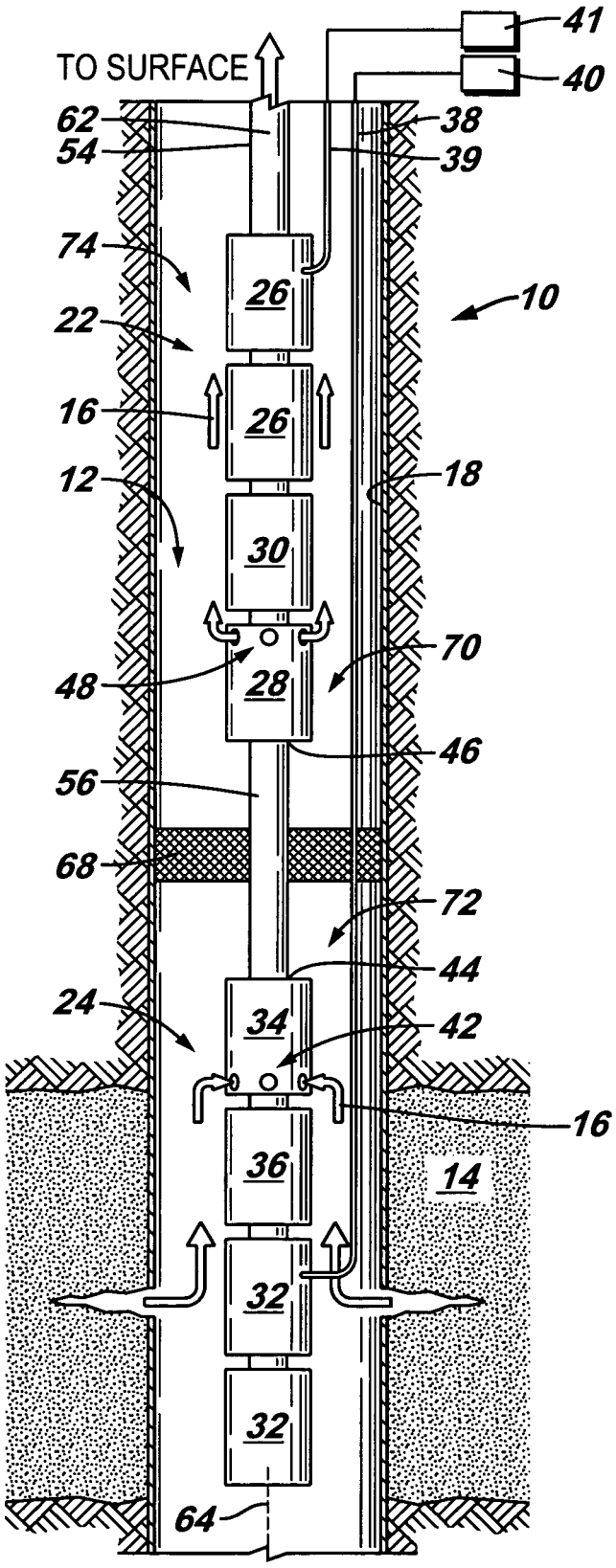
FIG. 3 is another embodiment of the submersible pumping system illustrated in FIG. 1.

Referring generally to FIG. 3, another embodiment of system 10 is illustrated. In this embodiment, a packer 68 is deployed about an extended coupling 56 to separate wellbore 12 into an upper wellbore section 70 and a lower wellbore section 72. The packer 68 is deployed between the downstream electric submersible pumping system 22 and the upstream electric submersible pumping system 24.

As illustrated, fluid 16 is drawn into pump intake 42 and pumped through packer 68 via extended coupling 56 to pump intake 46 of submersible pump 28. The fluid 16 is discharged from pump 28 at fluid discharge end 48 and into an annulus 74 surrounding electric submersible pumping system 22. The fluid is then moved upwardly along annulus 74 to a desired collection point. In the embodiment illustrated, annulus 74 is formed by upper wellbore section 70 such that the fluid 16 is contained by wellbore casing 18 as it progresses upwardly to a collection point.

Figure 4:
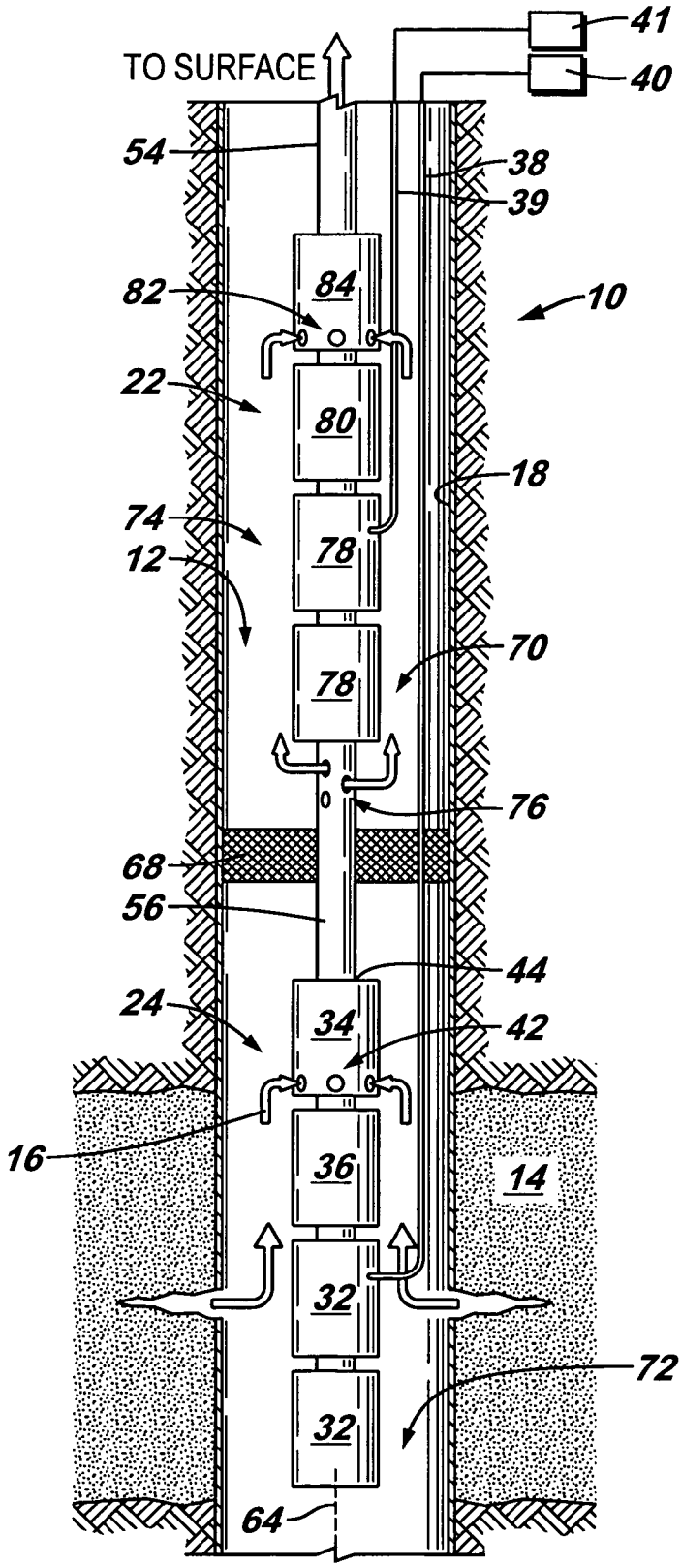
FIG. 4 is another embodiment of the submersible pumping system illustrated in FIG. 1.

In another embodiment illustrated in FIG. 4, packer 68 again separates the downstream electric submersible pumping system 22 from the upstream electric submersible pumping system 24. However, in this embodiment, system 22 comprises a conventional electric submersible pumping system.

As described with reference to FIG. 3, upstream electric submersible pumping system 24 discharges fluid through packer 68 via coupling 56. The fluid is then discharged into upper wellbore section 70 through one or more discharge openings 76 formed in coupling 56 (see FIG. 4). The fluid 16 is forced along the annulus 74 surrounding, for example, one or more motors 78 and a motor protector 80. Subsequently, fluid is drawn into a pump intake 82 on a submersible pump 84, such as a centrifugal pump. Pump 84 moves fluid 16 to a desired collection point through, for example, the interior of tubing 54. It should be noted that in the embodiments illustrated in FIGS. 3 and 4, annulus 74 can be formed by casing 18 or by other walls, such as a wall of a surrounding shroud.

Although only a few embodiments of the present invention have been described in detail above, those of ordinary skill in the art will readily appreciate that modifications are possible without materially departing from the teachings of this invention. Accordingly, such modifications are intended to be included within the scope of this invention as defined in the claims.

What is claimed is:

1. A submersible pumping system, comprising:

a lower electric submersible pumping system having a lower system motor and a lower system pump disposed in a downstream direction from the lower system motor; and an upper electric submersible pumping system having an upper system motor and an upper system pump disposed in an upstream direction from the upper system motor, wherein the upper system pump is hydraulically coupled to the lower system pump to enable delivery of fluid pumped from the lower system pump to the upper system pump.

2. The submersible pumping system as recited in claim 1, further comprising a shroud disposed about the upper system motor to route fluid from the upper system pump along the exterior of the upper system motor.

3. The submersible pumping system as recited in claim 1, wherein the lower electric submersible pumping system has a lower system centerline and the upper electric submersible pumping system has an upper system centerline aligned with the lower system centerline.

4. The submersible pumping system as recited in claim 1, wherein the lower system motor comprises a plurality of motors connected in tandem.

5. The submersible pumping system as recited in claim 1, wherein the upper system motor comprises a plurality of motors connected in tandem.

6. The submersible pumping system as recited in claim 1, further comprising a single tubing for suspending the lower and upper electric submersible pumping systems and for conducting produced fluid to a desired collection point.

7. The submersible pumping system as recited in claim 1, further comprising a packer disposed between the lower and the upper electric submersible pumping systems.

8. The submersible pumping system as recited in claim 1, wherein the lower electric submersible pumping system is electrically independent of the upper electric submersible pumping system.

9. The submersible pumping system as recited in claim 1, wherein the lower and the upper electric submersible pumping systems are both powered by a single drive.

10. A submersible pumping system, comprising:

a bottom intake electric submersible pumping system; and an electric submersible pumping system positioned to discharge a fluid to an intake of the bottom intake electric submersible pumping system, the electric submersible pumping system being independently controlled and disposed along a common centerline with the bottom intake electric submersible pumping system.

11. The submersible pumping system as recited in claim 10, wherein the bottom intake electric submersible pumping system is physically connected to the electric submersible pumping system.

12. The submersible pumping system as recited in claim 11, wherein the bottom intake electric submersible pumping system comprises a first drive shaft, and the electric submersible pumping system comprises a second drive shaft able to rotate independently of the first drive shaft.

13. The submersible pumping system as recited in claim 10, wherein the electric submersible pumping system comprises at least two motors.

14. The submersible pumping system as recited in claim 10, wherein the bottom intake electric submersible pumping system comprises at least two motors.

15. The submersible pumping system as recited in claim 10, further comprising a packer disposed between the bottom intake electric submersible pumping system and the electric submersible pumping system.

16. The submersible pumping system as recited in claim 10, further comprising a shroud, wherein the bottom intake electric submersible pumping system discharges fluid into the shroud to route the fluid past a motor of the bottom intake electric submersible pumping system.

17. The submersible pumping system as recited in claim 16, further comprising a tubing coupled to the bottom intake electric submersible pumping system, the tubing having an inlet through which the fluid flows from the shroud to an interior of the tubing for production to a desired location.

18. A submersible pumping system, comprising:

a downstream electric submersible pumping system having a first pump connected to a first motor by a first shaft;

an upstream electric submersible pumping system having a second pump connected to a second motor by a second shaft while being mechanically independent of the downstream electric submersible pumping system and disposed generally along a common centerline with the downstream electric submersible pumping system, wherein the upstream electric submersible pumping system delivers a fluid to an intake of the downstream electric submersible pumping system.

19. The submersible pumping system as recited in claim 18, further comprising a packer disposed between the downstream electric submersible pumping system and the upstream electric submersible pumping system.

20. The submersible pumping system as recited in claim 19, wherein the upstream electric submersible pumping system discharges a fluid through the packer and around a motor of the downstream electric submersible pumping system to the intake.

21. The submersible pumping system as recited in claim 18, wherein the upstream electric submersible pumping system discharges a fluid along an annulus suffounding a motor of the downstream electric submersible pumping system and to the intake.

22. A method for producing a fluid, comprising:

linearly aligning a first electric submersible pumping system with a second electric submersible pumping system;

operating the first electric submersible pumping system independently of the second electric submersible pumping system;

discharging a fluid from the first electric submersible pumping system to an intake of the second electric submersible pumping system; and physically coupling the first electric submersible pumping system and the second electric submersible pumping system while maintaining separation of a first system drive shaft and a second system drive shaft.

23. The method as recited in claim 22, further comprising discharging the fluid from the second electric submersible pumping system into a shroud; and routing the fluid through the shroud and around a motor of the second electric submersible pumping system.

24. The method as recited in claim 23, further comprising directing the fluid from the shroud into a production tubing.

25. The method as recited in claim 22, wherein operating comprises initiating operation by starting the first electric submersible pumping system and subsequently starting the second electric submersible pumping system.

26. The method as recited in claim 22, wherein discharging comprises discharging through a packer and into an annulus surrounding the second electric submersible pumping system.

27. A method for increasing available horsepower in a submersible pumping system, comprising:

aligning a plurality of electric submersible pumping systems in a wellbore;

maintaining a drive shaft of each electric submersible pumping system mechanically independent of the drive shaft of a next sequential electric submersible pumping system; and discharging a fluid from one electric submersible pumping system to a pump intake of the next sequential electric submersible pumping system.

28. The method as recited in claim 27, further comprising utilizing at least one bottom intake electric submersible pumping system.

29. The method as recited in claim 27, further comprising independently controlling each electric submersible pumping system.

* * * * *